US011104164B2

(12) United States Patent
Kohnotoh et al.

(10) Patent No.: US 11,104,164 B2
(45) Date of Patent: Aug. 31, 2021

(54) INKJET PRINTING APPARATUS AND METHOD FOR CONTROLLING THE INKJET PRINTING APPARATUS

(71) Applicant: CANON KABUSHIKI KAISHA, Tokyo (JP)

(72) Inventors: Atsushi Kohnotoh, Kawasaki (JP); Atsushi Miyahara, Higashikurume (JP); Kazunori Yamauchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/364,461

(22) Filed: Mar. 26, 2019

(65) Prior Publication Data

US 2019/0299687 A1 Oct. 3, 2019

(30) Foreign Application Priority Data

Mar. 30, 2018 (JP) ..... JP2018-068360

(51) Int. Cl.

| | |
|---|---|
| ***B41J 2/175*** | (2006.01) |
| ***B41J 29/38*** | (2006.01) |
| ***B41J 2/155*** | (2006.01) |
| ***B41J 2/14*** | (2006.01) |
| ***B41J 25/304*** | (2006.01) |
| ***B41J 2/18*** | (2006.01) |

(52) U.S. Cl.

CPC ..... *B41J 29/38* (2013.01); *B41J 2/14* (2013.01); *B41J 2/155* (2013.01); *B41J 2/175* (2013.01); *B41J 2/1752* (2013.01); *B41J 2/18* (2013.01); *B41J 25/304* (2013.01); *B41J 2002/14491* (2013.01)

(58) Field of Classification Search

CPC . B41J 29/38; B41J 2/1752; B41J 2/155; B41J 2/14; B41J 25/304; B41J 2002/14491; B41J 2/18; B41J 2/175; B41J 29/02; B41J 2/16514; B41J 25/34; B41J 2/16588

See application file for complete search history.

(56) References Cited

U.S. PATENT DOCUMENTS

| | | | | |
|---|---|---|---|---|
| 8,141,978 | B2 * | 3/2012 | Miyazawa | B41J 19/202 347/19 |
| 10,110,757 | B2 * | 10/2018 | Eiyama | H04N 1/00034 |
| 2009/0153611 | A1 * | 6/2009 | Shimizu | B41J 2/16511 347/19 |

FOREIGN PATENT DOCUMENTS

| | | |
|---|---|---|
| JP | 2012-116006 A | 6/2012 |

* cited by examiner

*Primary Examiner* — Sharon Polk

(74) *Attorney, Agent, or Firm* — Venable LLP

(57) ABSTRACT

There are provided an inkjet printing apparatus capable of maintaining posture of a holder regardless of presence or absence of an item which the holder supports and a method for controlling the inkjet printing apparatus. For this purpose, based on a change value Dsi of a rotary encoder 110 while driving a carriage motor 92 with driving force capable of maintaining posture of a head holder 90 which does not support a print head 8, the presence or absence of the print head 8 which the head holder 90 supports.

17 Claims, 16 Drawing Sheets

INKJET PRINTING APPARATUS AND METHOD FOR CONTROLLING THE INKJET PRINTING APPARATUS

BACKGROUND OF THE INVENTION

Field of the Invention

The present invention relates to an inkjet printing apparatus for printing by ejecting ink from a print head, and specifically relates to an inkjet printing apparatus for performing position control of a line-head type print head and to a method for controlling the inkjet printing apparatus.

Description of the Related Art

Japanese Patent Laid-Open No. 2012-116006 describes a method for adjusting a gap between a print medium and a print head by causing a carriage equipped with the print head to ascend/descend while performing PID control. Specifically, in the case of descending, only the proportional control in the PID control is enabled and the control is performed, while in the case of ascending, the control is switched and any of the proportional control, integral control, and derivative control in the PID control is enabled and the control is performed.

Generally, a line-head type machine is heavy due to the complexity of the internal structure thereof and/or due to storing a large amount of ink therein. In such a case where the PID control is used as the control for maintaining the posture of a heavy line-head, it may be difficult to set an appropriate parameter, so the control may be unable to be switched successfully. Then, as a simple control, the control to feed a predetermined current through a motor is alternatively used. This is a method for maintaining the posture of a holder by feeding a predetermined current through the motor so that the motor generates force for maintaining the posture of the holder equipped with a print head. The weight differs between a case where a holder is equipped with a print head and a case where a holder is not equipped with a print head, i.e., a case with only a holder. Therefore, in a case where the above-described method is employed, the current for maintaining the posture of a holder needs to be switched between a case where a holder is equipped with a print head and a case where a holder is not equipped with a print head, i.e., a case with only a holder.

Whether or not a print head is mounted on a holder can be determined by reading a contact state of an electric contact. Then, the posture of a holder can be maintained by determining the presence or absence of the print head from a contact state of an electric contact and setting the current for maintaining the posture to an optimum current.

However, in a case where the electric contact of a print head is broken and/or a contact failure occurs, a print head may be mistaken as not being mounted despite the fact that the print head has been mounted. In this case, the current to be fed to maintain the posture of a holder results in a weak current corresponding to a state where a print head is not mounted. However, because actually a print head has been mounted, the posture cannot be maintained due to the weight of the print head and therefore a holder might drop downward.

SUMMARY OF THE INVENTION

Accordingly, the present invention provides an inkjet printing apparatus capable of maintaining posture of a holder regardless of presence or absence of an item which the holder supports and a method for controlling the inkjet printing apparatus.

Therefore, an inkjet printing apparatus of the present invention comprising: a holder unit capable of holding a print head and movable in directions including a gravity direction; a drive unit configured to drive the holder unit; an acquisition unit configured to acquire a moving amount of the holder unit; and a determination unit configured to determine whether or not the holder unit holds the print head, wherein the determination unit determines based on the moving amount acquired by the acquisition unit while the drive unit is driving the holder unit with a first driving force capable of maintaining a posture of the holder unit which does not hold the print head.

According to the present invention, an inkjet printing apparatus capable of maintaining the posture of a holder regardless of the presence or absence of an item which the holder supports and a method for controlling the inkjet printing apparatus can be realized.

Further features of the present invention will become apparent from the following description of exemplary embodiments with reference to the attached drawings.

DESCRIPTION OF THE EMBODIMENTS

First Embodiment

Hereinafter, a first embodiment of the present invention will be described with reference to the attached drawings.

Figure 1:
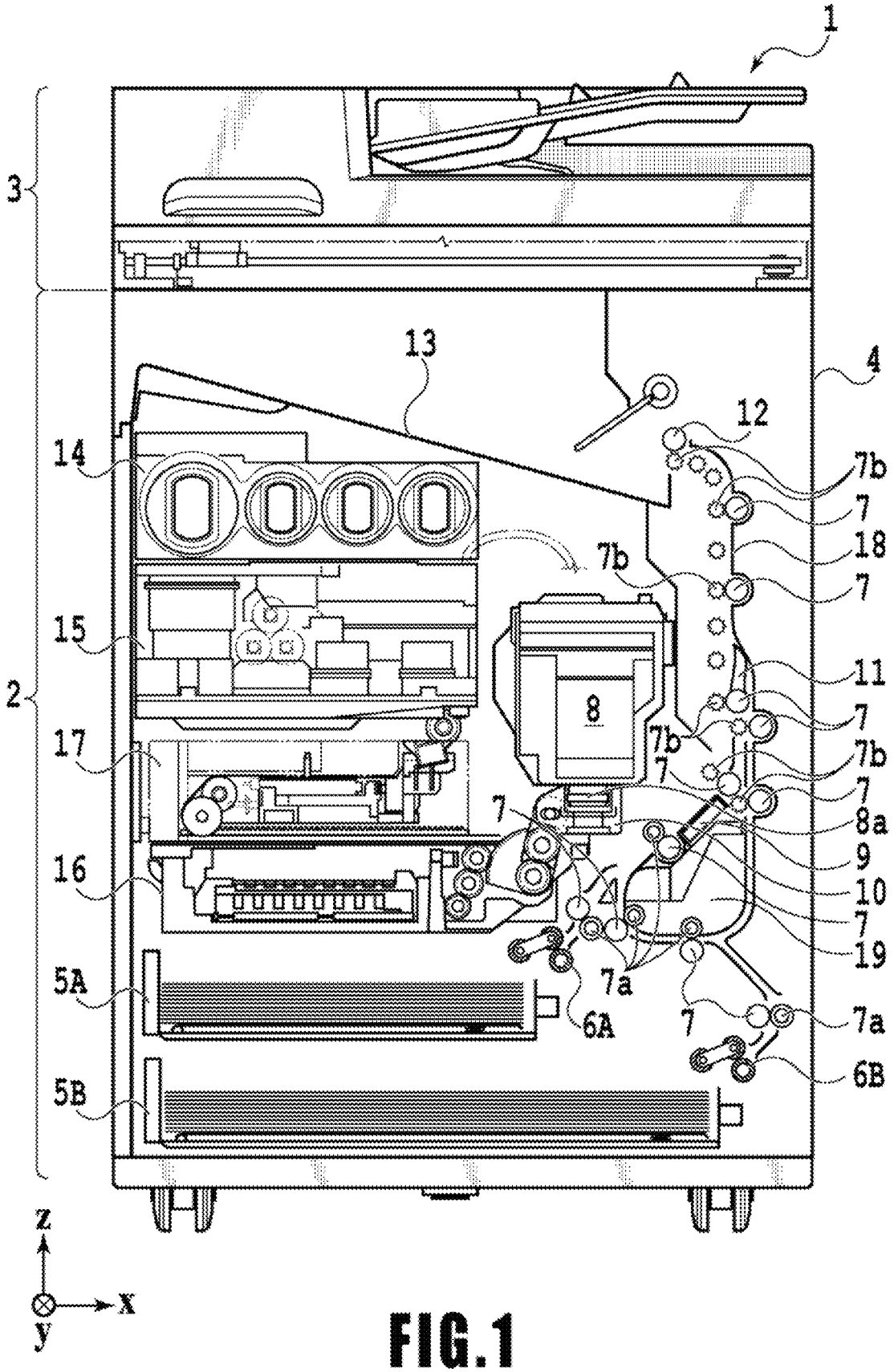
FIG. 1 shows an internal configuration of an inkjet printing apparatus.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing medium (cut sheets) S are detachably provided at the bottom of a casing 4 in the vertical direction. Relatively small printing medium of up to A4 size are stacked and housed in the first cassette 5A and relatively large printing medium of up to A3 size are stacked and hosed in the second cassette 5B. A first feeding unit 6A for feeding housed printing medium one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 (platen 9) and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8 (platen 9).

The printing apparatus 1 has multiple motors for driving the above drive rollers, and each drive roller is connected to one of the motors. The relationship between the motors and the drive roller will be described later in detail.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing printing medium S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
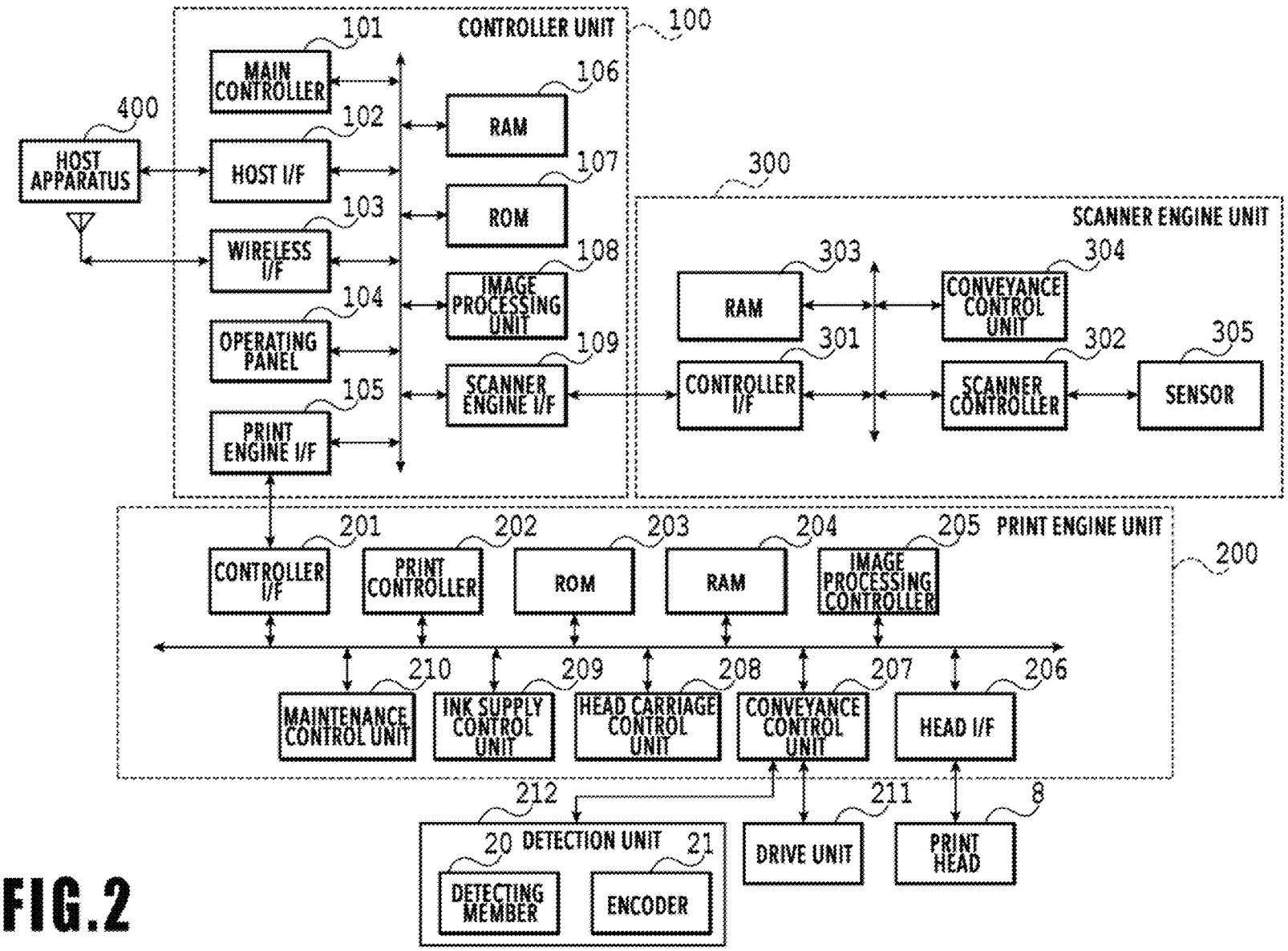
FIG. 2 is a block diagram showing a control configuration in a printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

The conveyance control unit 207, connected to the detection unit 212 for detecting the conveyance state of the printing medium S and the drive unit 211 for driving the drive rollers, controls the conveyance of the printing medium S using the drive unit 211, based on detection results obtained from the detection unit 212. The detection unit 212 has the detection members 20 for detecting the printing medium S and the encoders 21 for detecting the amount of rotation of the drive rollers.

Printing is performed in the course of the conveyance of the printing medium S by the conveyance control unit 207, by the print head 8 performing print operation under instructions from the print controller 202.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3.

For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
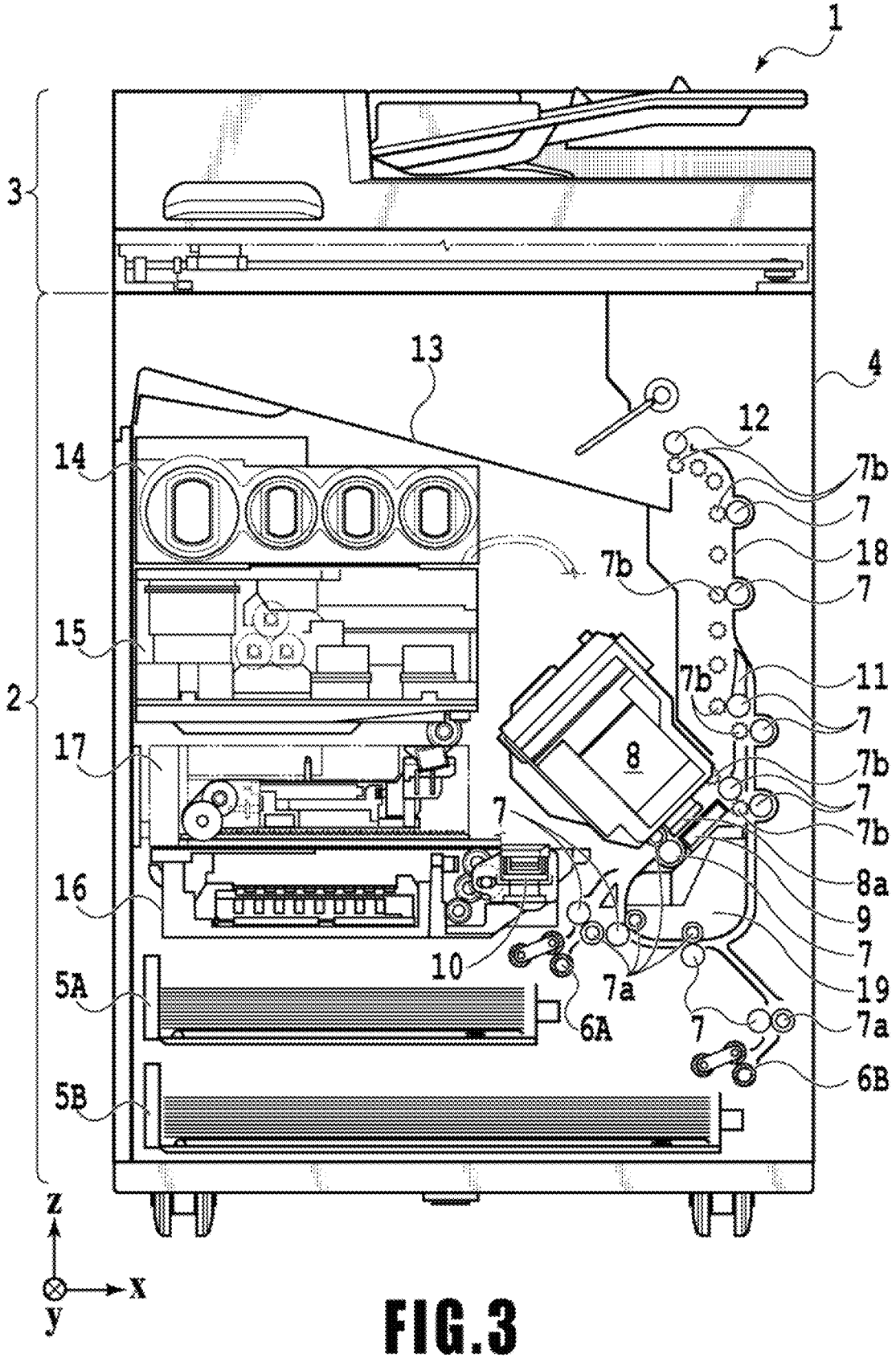
FIG. 3 shows the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member from the ejection opening surface 8*a* of the print head 8. The print controller 202 then uses the head carriage control unit 208 to turn the print head 8 by 45° while adjusting the vertical height of the print head 8 such that the ejection opening surface 8*a* faces the platen 9. After the completion of print operation, the print controller 202 reverses the above procedure in moving the print head 8 from the printing position to the standby position.

Next, a conveying path of the print medium S in the print unit 2 will be described. Upon receipt of a print command, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B to feed the print medium S in accordance with the print command.

Figure 4C:
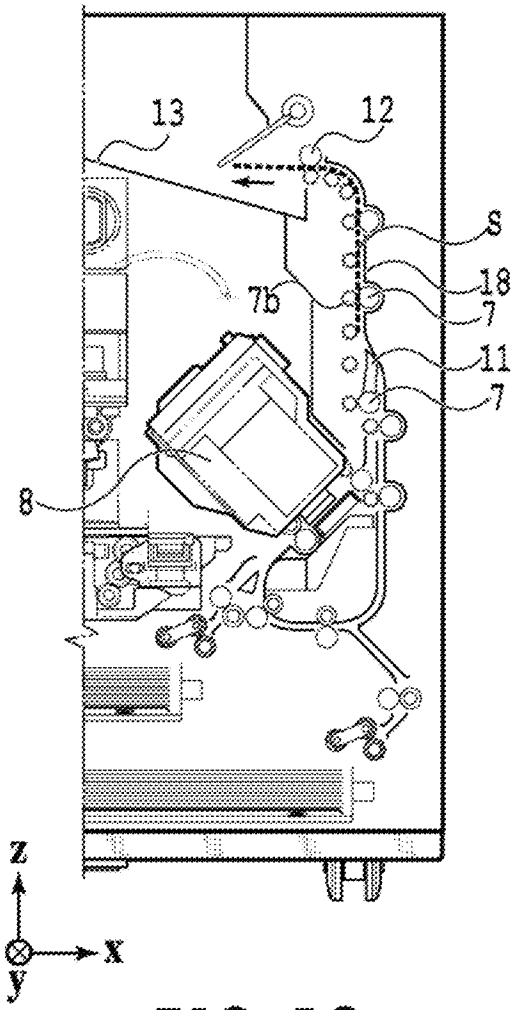
FIG. 4C shows a conveying path in the case where a print medium is fed.
Figure 4B:
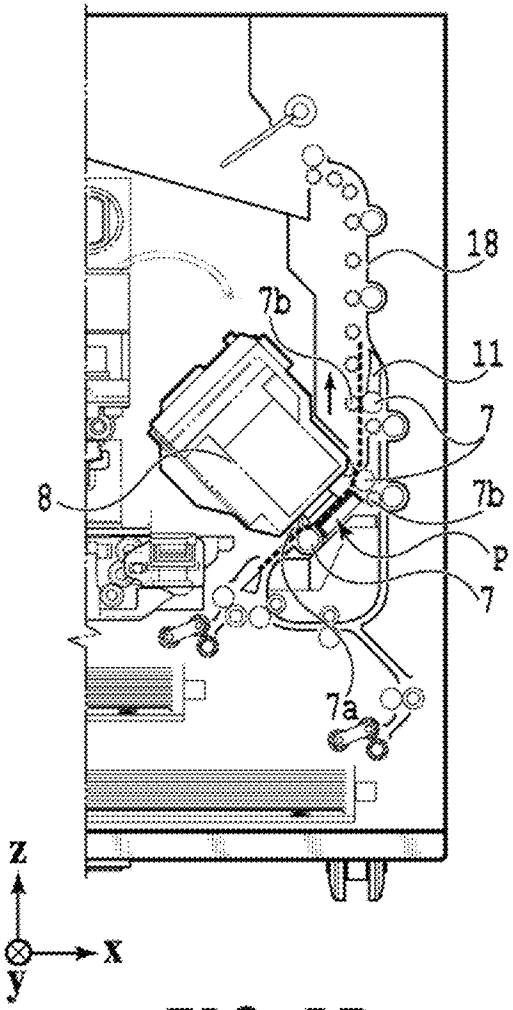
FIG. 4B shows a conveying path in the case where a print medium is fed.
Figure 4A:
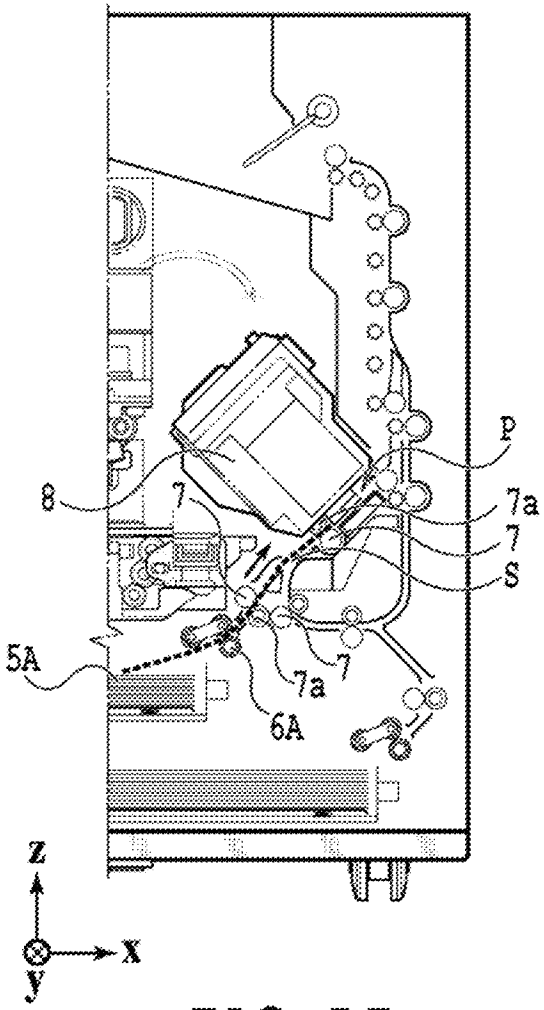
FIG. 4A shows a conveying path in the case where a print medium is fed.

FIGS. 4A to 4C are diagrams showing a conveying path in the case of feeding an A4 size print medium S from the first cassette 5A. A print medium S at the top of a stack of printing medium in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
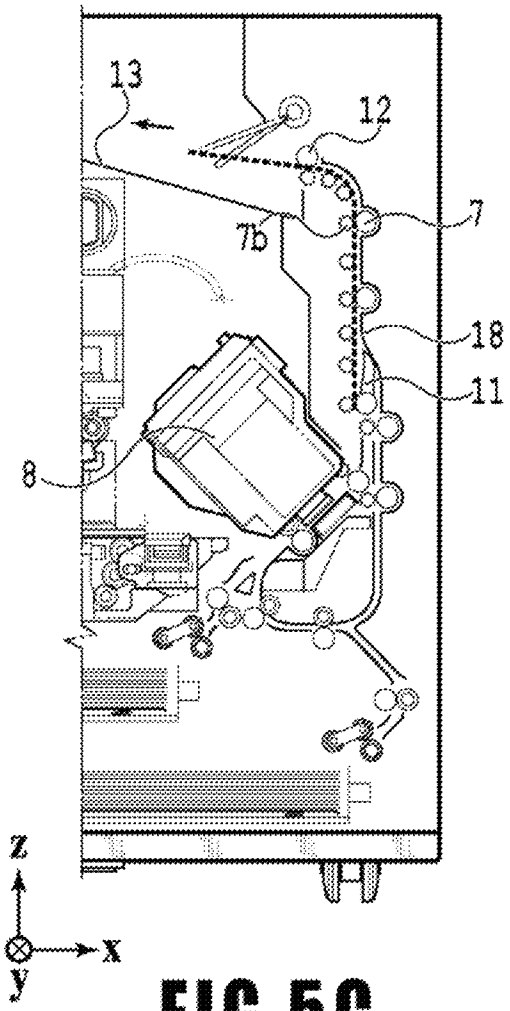
FIG. 5C shows a conveying path in the case where a print medium is fed.
Figure 5B:
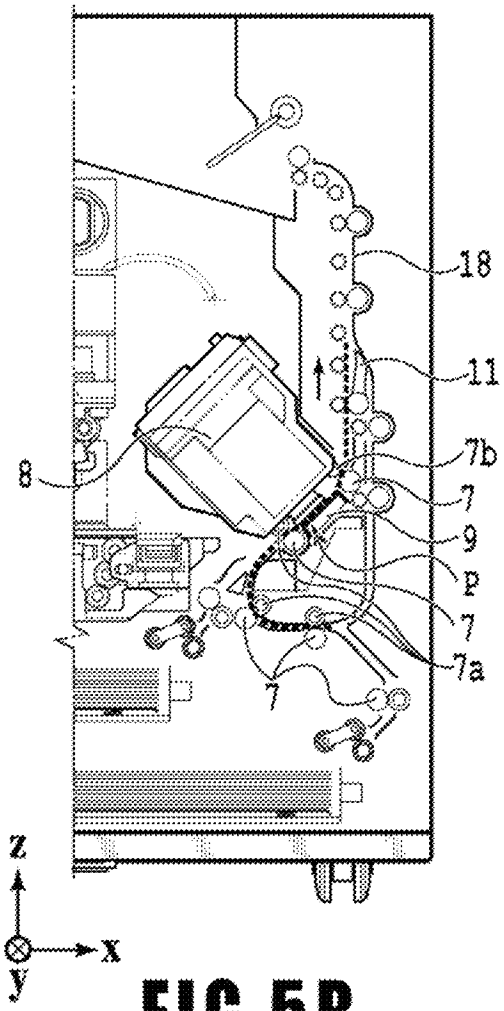
FIG. 5B shows a conveying path in the case where a print medium is fed.
Figure 5A:
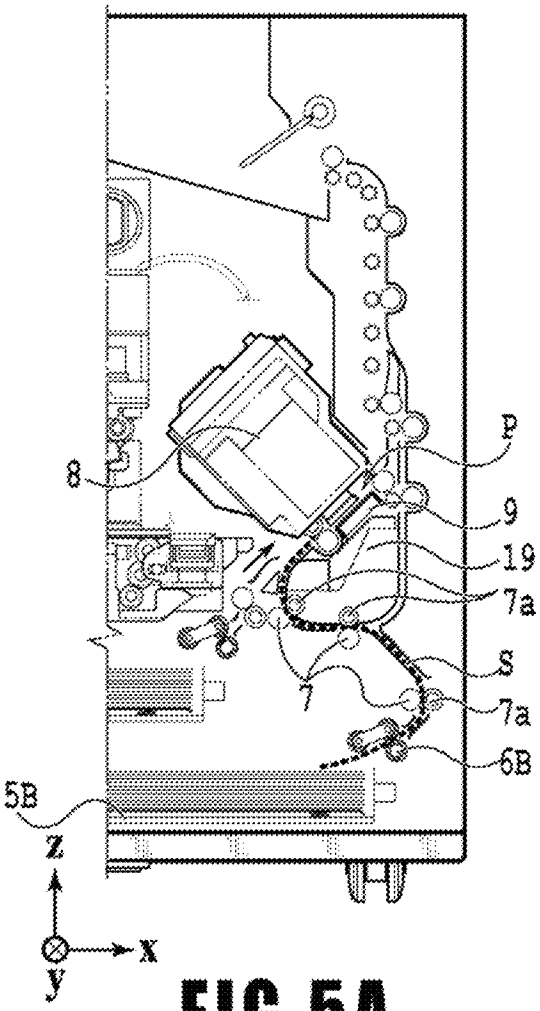
FIG. 5A shows a conveying path in the case where a print medium is fed.

FIGS. 5A to 5C are diagrams showing a conveying path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
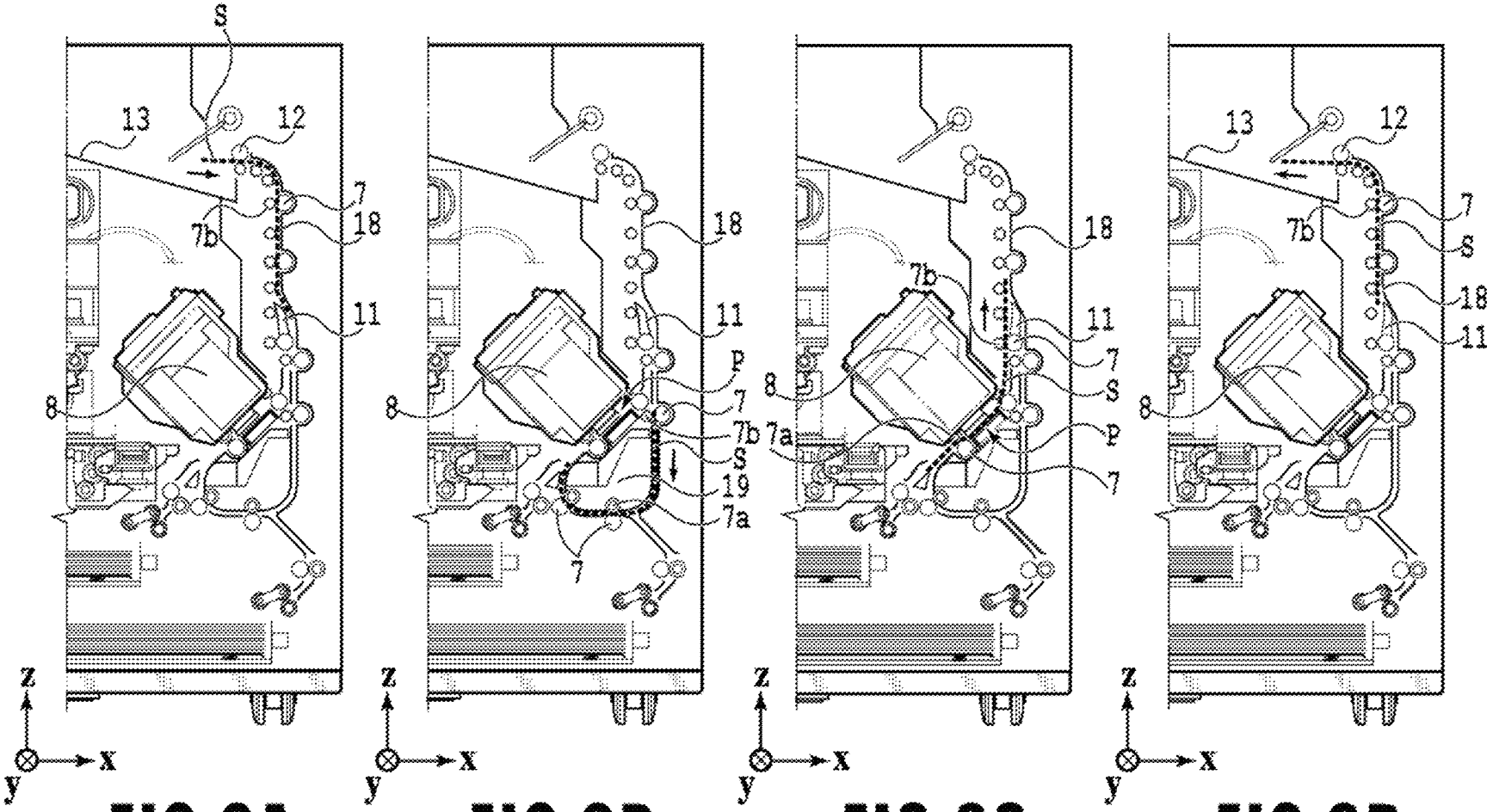
FIG. 6A shows a conveying path in the case of performing a print operation.
FIG. 6B shows a conveying path in the case of performing a print operation.
FIG. 6C shows a conveying path in the case of performing a print operation.
FIG. 6D shows a conveying path in the case of performing a print operation.

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
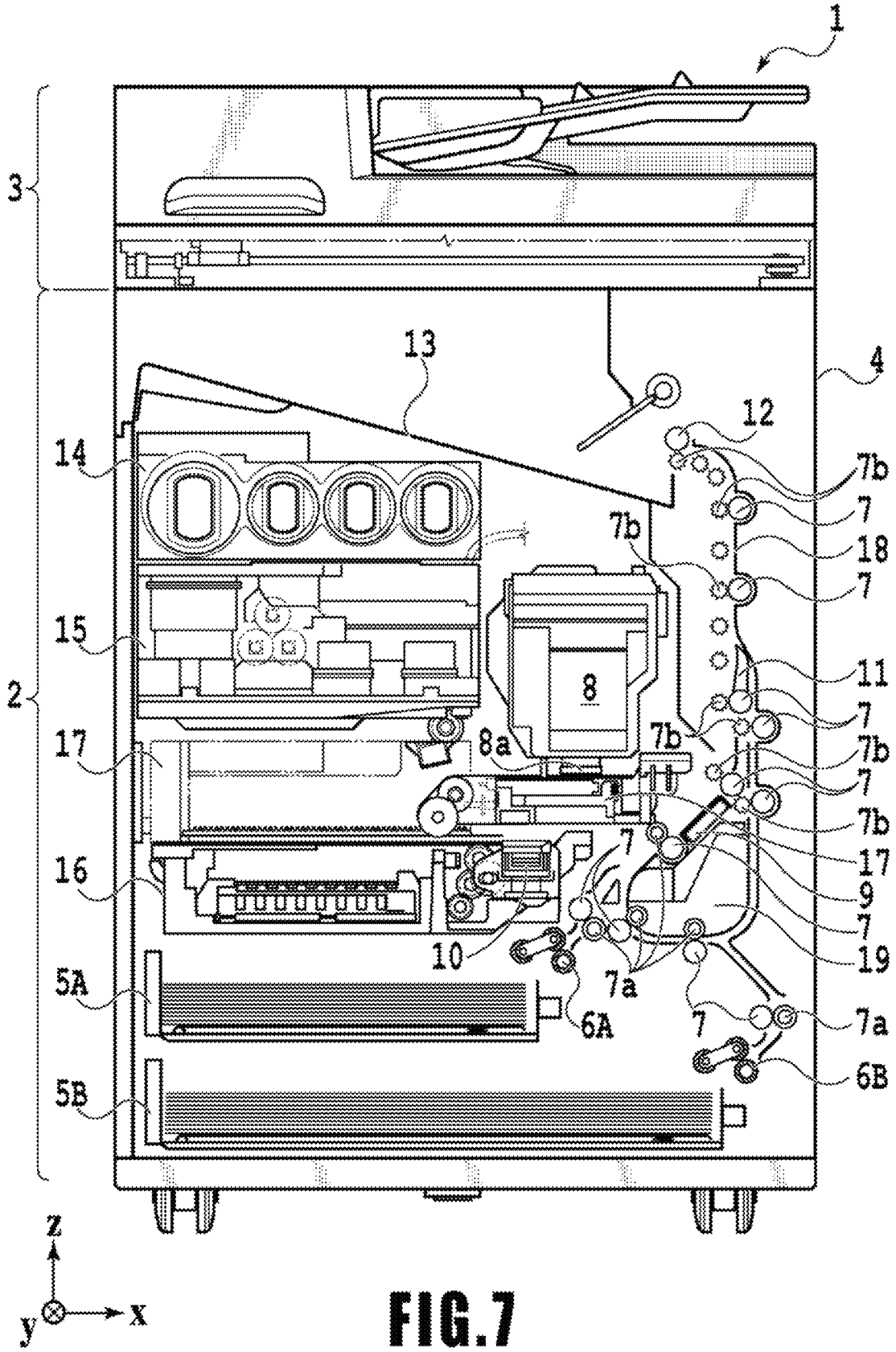
FIG. 7 shows a printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8:
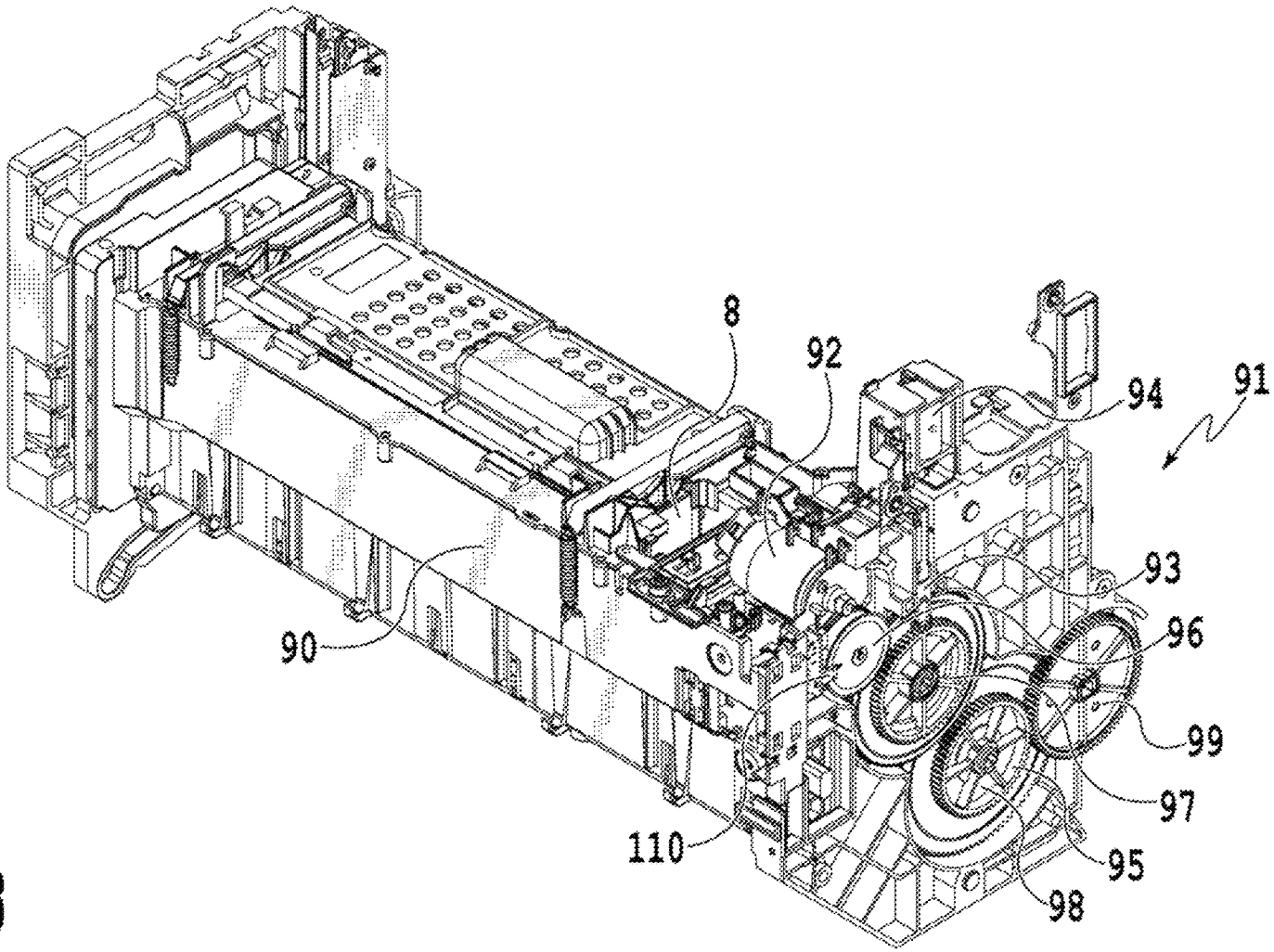
FIG. 8 shows a head holder and a drive unit for a head holder.

Hereinafter, the characteristic items of the present invention will be described. FIG. 8 shows a head holder 90 equipped with the print head 8, and a drive unit 91 of the head holder 90. The head holder 90 is capable of supporting the print head 8, and the drive unit 91 of the head holder 90 includes: a carriage motor 92; and a gear train 95 including a plurality of gears which transmit the driving force of the carriage motor 92. The gear train 95 includes a first gear 96 which engages with the gear of the carriage motor 92, a second gear 97 which engages with the first gear 96, a third gear 98 which engages with the second gear 97, and a fourth gear 99 which engages with the third gear 98. By driving the carriage motor 92 and transmitting the driving force thereof with the gear train 95, the posture of the print head 8 during printing can be changed and/or the print head 8 can be moved to a maintenance position (the print head 8 is movable in directions including the gravity direction). Moreover, the drive unit 91 includes a rotary encoder 110, so the rotation of the carriage motor 92 can be measured by detecting the rotation of the first gear 96 and the moving amount of the head holder 90 with the rotary encoder 110. Furthermore, the drive unit 91 includes a lock mechanism 93 which mechanically locks the rotation of the second gear 97.

Figure 9:
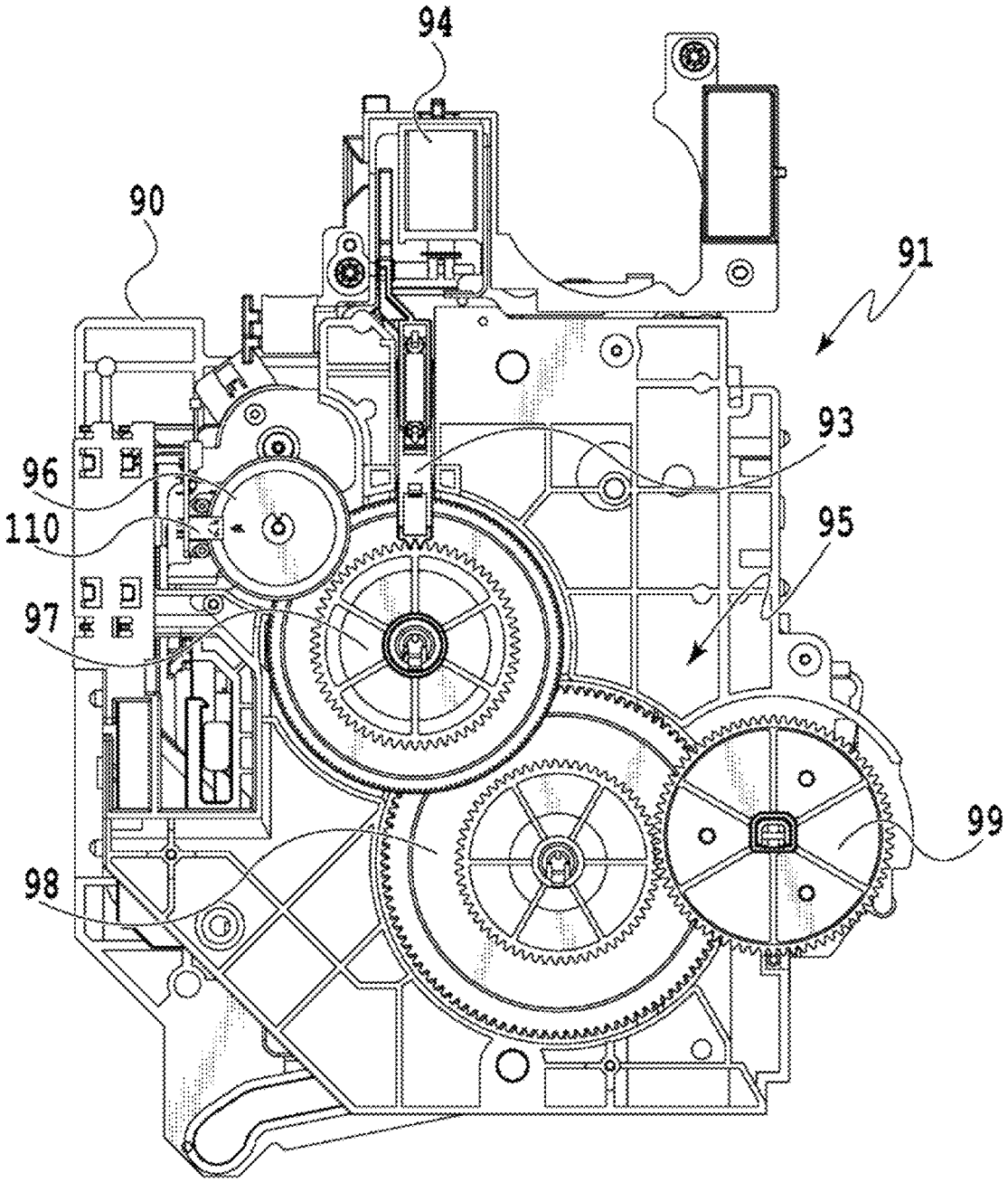
FIG. 9 shows a drive unit.

FIG. 9 shows the drive unit 91. By activating the lock mechanism drive unit 94, the lock mechanism 93 can engage with the second gear 97 to stop the rotation and mechanically fix the second gear 97. By fixing the second gear 97, the whole gear train 95 can be fixed. That is, by activating the lock mechanism 93, the movement of the head holder 90 can be fixed to maintain the posture of the print head 8. As described above, by activating the lock mechanism 93 and fixing the gear train 95, the posture of the print head 8 can be maintained without energizing the carriage motor 92. Therefore, when maintaining the posture of the print head 8 at a predetermined position, it is effective to lock the gear train 95 with the lock mechanism 93. Prior to releasing the lock of the lock mechanism 93, the posture of the print head 8 needs to be maintained by energizing the carriage motor 92 so that the print head 8 will not descend due to its weight.

In the printing apparatus 1, since the print head 8 has been inserted into the head holder 90, maintaining the posture of the print head 8 results in maintaining the posture of the head holder 90. As previously described, the print head 8 is a full-line type color inkjet print head, in which a plurality of ejection ports each for ejecting ink in accordance with print data are arranged, by a width corresponding to a width of the print medium S. A line-head like the print head 8 is generally heavy due to the complexity of the internal structure thereof and/or due to the amount of ink supplied to the inside of the print head. Accordingly, to maintain the posture of the head holder 90 into which the print head 8 has been inserted, the carriage motor 92 needs to be energized with a current corresponding to the weight of the head holder 90 into which the print head 8 has been inserted. Moreover, in a case where the print head 8 has not been inserted into the head holder 90, the carriage motor 92 needs to be energized with a current corresponding to the weight of the head holder 90 into which the print head 8 has not been inserted.

As described above, to maintain the posture of the head holder 90, it is necessary to determine whether the print head 8 has been inserted into the head holder 90. Then, in this embodiment, the head holder 90 includes a non-shown electric contact. Once the print head 8 is inserted into the head holder 90, then the print head 8 and the head holder 90 are electrically connected because the electric contact point of the print head 8 comes into contact with the electric contact of the head holder 90, so that it can be confirmed that the print head 8 has been inserted into the head holder 90. After determining whether or not the print head 8 has been inserted, the carriage motor 92 is energized with a current corresponding to each state, so that the posture of the head holder 90 can be appropriately maintained in accordance with the presence or absence of the print head 8 (item to be supported).

However, in cases where a contact failure between the contact point provided in the print head 8 and the electric contact of the head holder 90 occurs, it may be determined that the print head 8 has not been inserted despite the fact that it has been inserted. In this case, the carriage motor 92 is energized with a weak current corresponding to the weight of the head holder 90 into which the print head 8 has not been inserted. As the result, the carriage motor 92 is not capable of maintaining the posture of the head holder 90, so the head holder 90 might descend.

Then, in this embodiment, in a case where it is determined, based on the measurement result of the electric connection, that the print head 8 has not been mounted, the head holder 90 is first moved to a determination position at which it is unlikely to touch another unit. Then, while in this determination position, reading a signal of the rotary encoder 110 of the carriage motor 92, the posture of the head holder 90 is attempted to be maintained with a weak current capable of maintaining the posture of the head holder 90 not equipped with the print head 8. At this time, from the signal of the rotary encoder 110, if the moving amount of the head holder 90 is equal to or less than a predetermined threshold, then it is determined that the posture can be maintained and that the print head 8 has not been mounted. On the contrary, if the moving amount of the head holder 90 is greater than the predetermined threshold, then the posture cannot be maintained, indicating that the head holder 8 has descended. That is, the print head 8 may have been actually mounted on the head holder 90, so the head holder 90 is returned to the determination position. Then, while reading the signal of the rotary encoder 110, the posture of the head holder 90 is attempted to be maintained with a current capable of maintaining the posture of the head holder 90 equipped with the print head 8. As the result, if the moving amount of the head holder 90 is equal to or less than the predetermined threshold, it is determined that the print head 8 has been mounted.

As described above, it can be precisely determined whether the print head 8 has been mounted on the head holder 90 by determining a current for energizing carriage motor 92 in combination with the signal of the rotary encoder 110.

Figure 10:
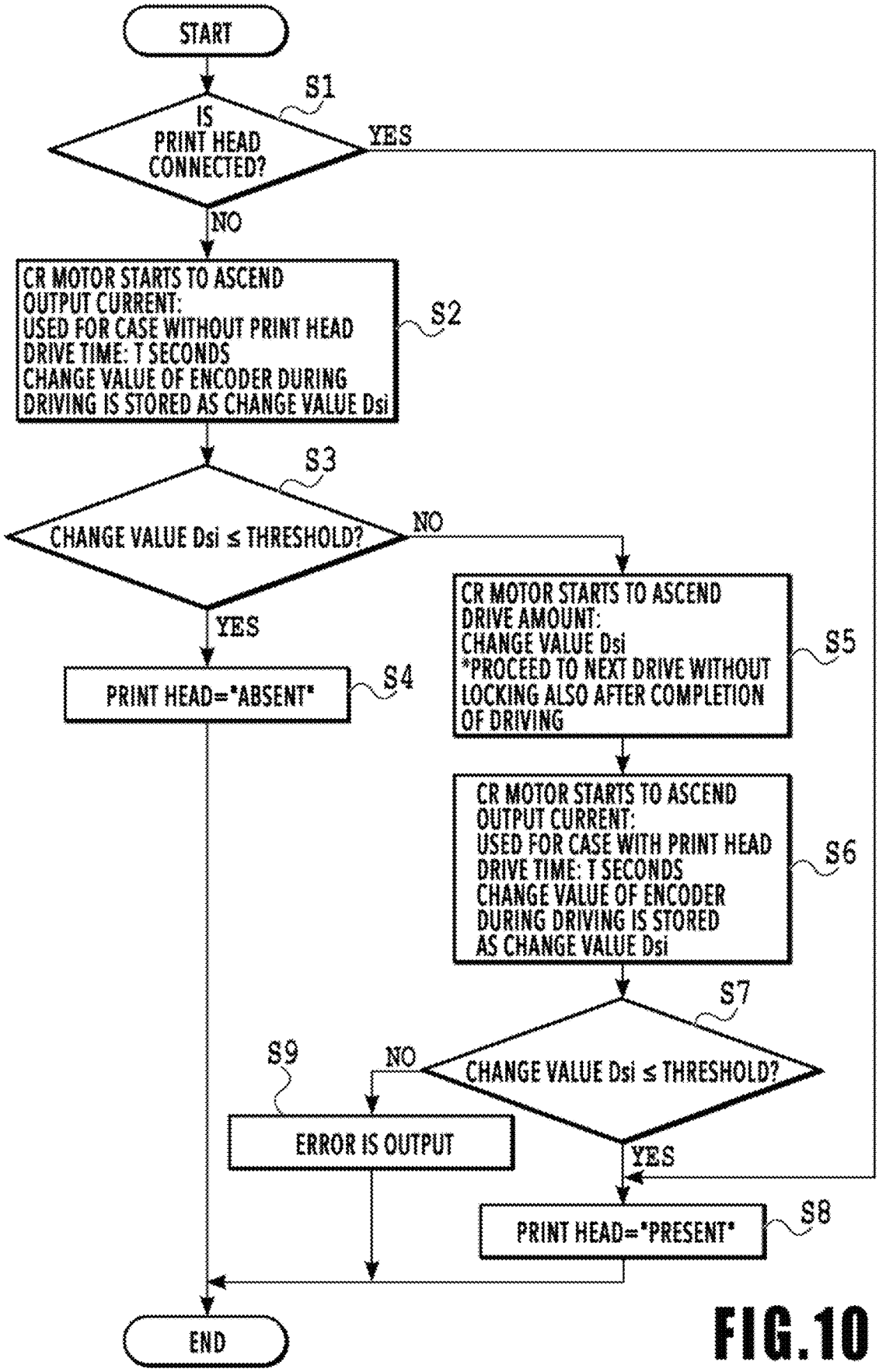
FIG. 10 is a flow chart showing a determination process to determine the presence or absence of a print head.

FIG. 10 is a flow chart showing the determination process to determine the presence or absence of the print head 8, in this embodiment. Hereinafter, the determination process to determine the presence or absence of the print head 8 of this embodiment will be described using this flow chart.

Once the determination process to determine the presence or absence of the print head 8 is started, then in S1, whether or not the print head 8 has been inserted into the head holder 8 is determined using the information obtained from the electric contact of the head holder 90. Because there is no misunderstanding in a case where it is determined that the print head 8 has been inserted, the flow transitions to S8, where a determination result that "the print head is present" is made and the process is terminated. In a case where it is determined, in S1, that the print head 8 has not been inserted, the flow transitions to S2, where the carriage motor 92 is driven for T seconds with a weak current capable of maintaining the posture of the head holder 90 not equipped with the print head 8. Then, a change value Dsi of the rotary encoder 110 for T seconds is stored into a memory.

Subsequently, in S3, the change value Dsi which was stored in S2 is compared with a threshold, and if the change value Dsi is equal to or less than the threshold, the determination result that "the print head is absent" is made in S4, and the process is terminated. If the change value Dsi is larger than the threshold, it is considered that the posture of the head holder 90 cannot be maintained with the weak current, so the moving amount may have become too large. Therefore, the flow transitions to S5, where the head holder 90 is moved by the moving amount corresponding to the change value Dsi and returned to the determination position. Then, in S6, while driving the carriage motor 92 for T seconds with a current capable of maintaining the posture of the head holder 90 equipped with the print head 8, the change value Dsi of the rotary encoder 110 for T seconds is stored into a memory. Subsequently, in S7, the change value Dsi which was stored in S6 is compared with a threshold, and if the change value Dsi is equal to or less than the threshold, the determination result that "the print head is present" is made in S8, and the process is terminated. If the change value Dsi is larger than the threshold, then it is determined that there is an abnormality in operation, and an error is output in S9 and the process is terminated.

As described above, based on the change value Dsi of the rotary encoder 110 while providing a predetermined current to the carriage motor 92, the presence or absence of the print head 8 which the head holder 90 supports is determined. Thus, an inkjet printing apparatus capable of appropriately maintaining the posture of the holder 90 regardless of the presence or absence of the print head 8 which the holder 90 supports and a method for controlling the inkjet printing apparatus can be realized.

Second Embodiment

Hereinafter, a second embodiment of the present invention will be described with reference to the accompanying drawings. Note that, because the basic configuration of this embodiment is similar to the configurations of the first embodiment, hereinafter only a characteristic configuration will be described.

The line-head type print head 8 used in this embodiment is capable of storing a lot of ink therein in use. Then, when exchanging the print head 8, the ink stored inside the print head 8 needs to be eliminated (collected) to prevent the ink stored therein from leaking. Between the print head 8 having ink stored therein and the print head 8 whose ink has been eliminated, the weight thereof differs by a weight corresponding to the ink stored therein. Then, in this embodiment, the presence or absence of the ink in the print head 8 is determined using a current corresponding to the print head 8 having ink stored therein and a current corresponding to the print head 8 whose ink has been eliminated.

Figure 11:
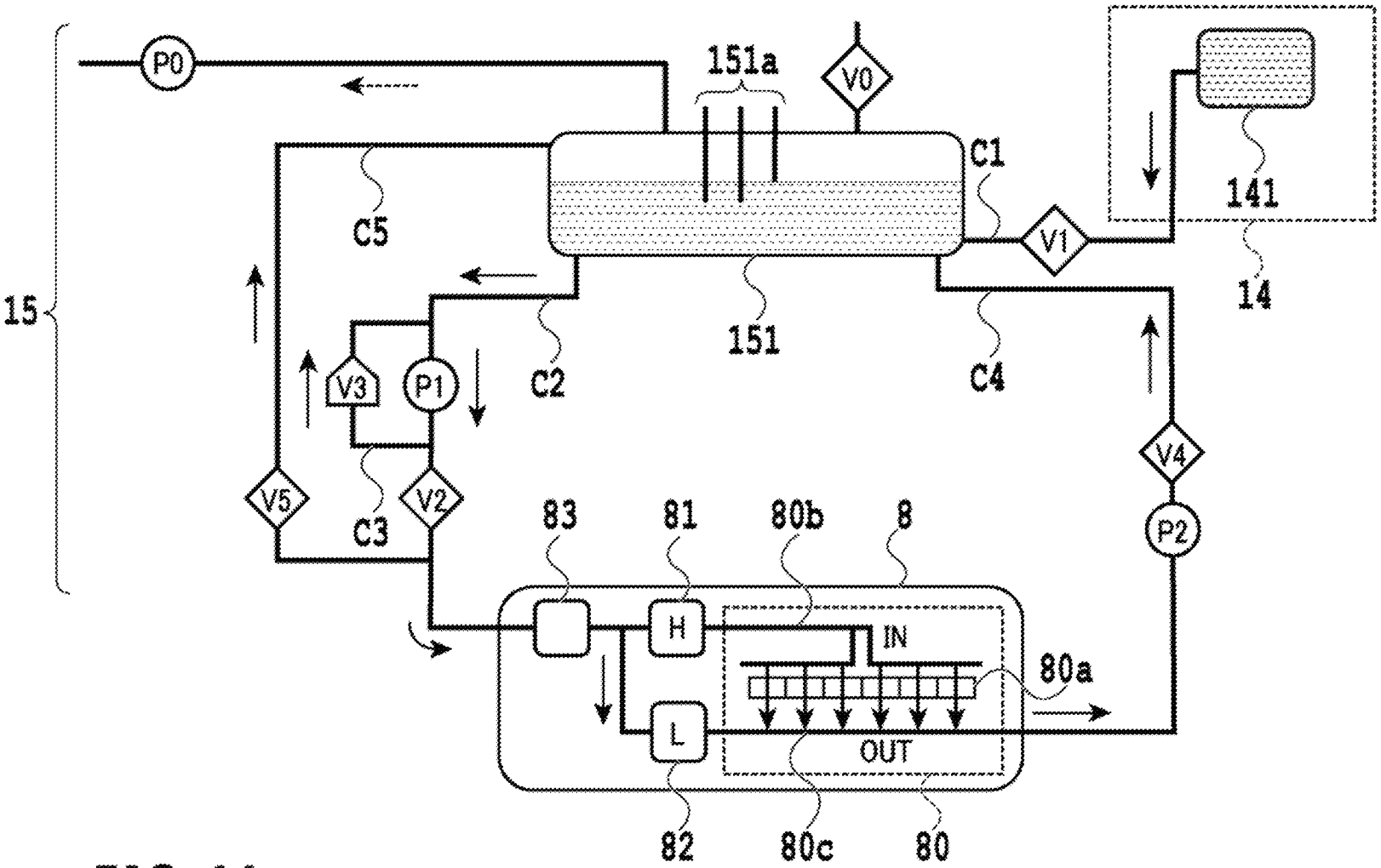
FIG. 11 includes an ink supply unit employed in an inkjet printing apparatus.

Here, a circulation system of ink in the inkjet printing apparatus 1 will be described. FIG. 11 includes the ink supply unit 15 employed in the inkjet printing apparatus 1 of this embodiment. A configuration of the flow path of the ink circulation system of this embodiment will be described using FIG. 11. The ink supply unit 15 is configured to supply ink to the print head 8 from the ink tank unit 14. Here, a configuration for one color of ink is shown, but actually such a configuration is prepared for each ink color. The ink supply unit 15 is controlled by the ink supply control unit 209. Hereinafter, each configuration of the unit will be described.

Ink mainly circulates between a sub-tank 151 and the print head 8. In the print head 8, ink ejection operation is performed based on image data, and ink which has not been ejected is again collected to the sub-tank 151.

The sub-tank 151 to store a predetermined amount of ink is connected to a supply flow path C2 for supplying ink to the print head 8 and a collection flow path C4 for collecting ink from the print head 8. That is, the sub-tank 151, the supply flow path C2, the print head 8, and the collection flow path C4 constitute a circulation path through which ink circulates.

A liquid level detection device 151*a* including a plurality of pins is provided in the sub-tank 151, and the ink supply control unit 209 can grasp the height of an ink level, i.e., the remaining amount of ink in the sub-tank 151, by detecting the presence or absence of a conduction current between these plurality of pins. A decompression pump P0 is a negative pressure generator for decompressing the inside of the sub-tank 151. An atmosphere open valve V0 is the valve for switching whether or not to communicate the inside of the sub-tank 151 with the atmospheric air.

A main tank 141 is the tank which stores the ink to be supplied to the sub-tank 151. The main tank 141 is made from a flexible member, and ink is filled into the sub-tank 151 due to a volume change of the flexible member. The main tank 141 is configured to be attachable/detachable to the body of the printing apparatus. In the midstream of the tank connecting flow path C1 which connects the sub-tank 151 and the main tank 141, a tank supply valve V1 for switching the connection of the sub-tank 151 and the main tank 141 is arranged.

Under such a configuration, when the ink supply control unit 209 detects, by the liquid level detection device 151*a*, that the amount of ink in the sub-tank 151 has become less than a predetermined amount, the ink supply control unit 209 closes the atmosphere open valve V0, a supply valve V2, a collection valve V4, and a head exchange valve V5, and opens the tank supply valve V1. In this state, the ink supply control unit 209 activates the decompression pump P0. Then, the inside of the sub-tank 151 has a negative pressure, so ink is supplied to the sub-tank 151 from the main tank 141. Once the ink supply control unit 209 detects, by the liquid level detection device 151*a*, that the amount of ink in the sub-tank 151 has exceeded a predetermined amount, the ink supply control unit 209 closes the tank supply valve V1 and stops the decompression pump P0.

The supply flow path C2 is the flow path for supplying ink to the print head 8 from the sub-tank 151, and in the midstream of the supply flow path C2 a supply pump P1 and the supply valve V2 are arranged. During the print operation, by driving the supply pump P1 while the supply valve V2 is opened, ink can be circulated in the circulation path while supplying ink to the print head 8. The amount of ink to be ejected per unit of time by the print head 8 varies depending on image data. The flow rate of the supply pump P1 is determined so as to be able to correspond to even a case where the print head 8 has performed ejection operation by which the ink consumption per unit of time becomes the maximum.

A relief flow path C3 is the flow path which is arranged on the upstream side of the supply valve V2 and which connects the upstream side and downstream side of the supply pump P1. The connection connected to the upstream side of the supply pump P1 is referred to as a first connection, while the connection connected to the downstream side is referred to a second connection. A relief valve V3 which is the differential pressure regulating valve is arranged in the midstream of the relief flow path C3. In a case where the ink supply amount per unit of time from the supply pump P1 is larger than a sum of the ejection amount per unit of time of the print head 8 and the flow rate (amount of ink to suck) per unit of time of the collection pump P2, the relief valve V3 is opened in accordance with the pressure acting thereon. As the result, a circulation flow path including a part of the supply flow path C2 and the relief flow path C3 is formed. By providing the above-described configuration of the relief flow path C3, the ink supply amount to the print head 8 is adjusted in accordance with the ink consumption per unit of time at the print head 8, and the pressure in the circulation path can be stabilized regardless of image data.

The collection flow path C4 is the flow path for collecting ink from the print head 8 to the sub-tank 151, and in the midstream thereof the collection pump P2 and the collection valve V4 are arranged. When circulating ink in the circulation path, the collection pump P2 acts as a negative pressure generator and sucks ink from the print head 8. Driving the collection pump P2 causes an appropriate pressure difference between an IN flow path 80*b* and OUT flow path 80*c* in the print head 8, so that ink can be circulated between the IN flow path 80*b* and the OUT flow path 80*c*. The configuration of the flow path in the print head 8 will be described in detail later.

The collection valve V4 is the valve for preventing the back flow in the case where print operation is not performed, i.e., in the case where ink is not being circulated in the circulation path. In the circulation path of this embodiment, the sub-tank 151 is arranged on the upper side in the vertical direction from the print head 8 (see FIG. 1). Therefore, in the case where the supply pump P1 and/or the collection pump P2 are not being driven, ink might flow back from the sub-tank 151 to the print head 8 due to an ink level difference between the sub-tank 151 and the print head 8. To prevent such a back flow, in this embodiment the collection valve V4 is provided in the collection flow path C4.

Similarly, the supply valve V2 also functions as a valve for preventing the supply of ink from the sub-tank 151 to the print head 8 in the case where the print operation is not being performed, i.e., in the case where ink is not being circulated in the circulation path.

A head exchange flow path C5 is the flow path which connects the supply flow path C2 and the air chamber (space in which ink is not stored) of the sub-tank 151, and in the midstream thereof the head exchange valve V5 is arranged. One end of the head exchange flow path C5 is connected to the upstream of the print head 8 in the supply flow path C2, and this connection is referred to as a third connection. The third connection is arranged on the downstream side of the supply valve V2. The other end of the head exchange flow path C5 is connected to an upper part in the gravity direction of the sub-tank 151 to communicate with the air chamber inside the sub-tank 151. This connection is referred to as a fourth connection. The head exchange flow path C5 is utilized in the case where ink is collected from the print head 8 in use, such as when exchanging the print head 8 and when transporting the printing apparatus 1. The head exchange valve V5 is controlled by the ink supply control unit 209 so as to close except in the case where ink is filled into the printing apparatus 1 or in the case where ink is collected from the print head 8. Moreover, the above-described supply valve V2 is provided, in the supply flow path C2, between the third connection to the head exchange flow path C5 and the second connection to the relief flow path C3. Note that the second connection may be arranged in the supply flow path C2 on the downstream side of the third connection.

In the case of collecting ink from the print head 8, the ink supply control unit 209 closes the atmosphere open valve V0, the tank supply valve V1, the supply valve V2, and the collection valve V4 and opens the head exchange valve V5, and drives the decompression pump P0. As the result, the inside of the sub-tank 151 becomes in a negative pressure state, the ink in the print head 8 is collected through the head exchange flow path C5 to the sub-tank 151. As described above, the head exchange valve V5 is the valve which is closed during the normal print operation and/or during standby and which is opened when collecting ink from the print head 8. However, also when filling ink into the head exchange flow path C5 in filling ink into the print head 8, the head exchange valve V5 is opened.

Figure 12:
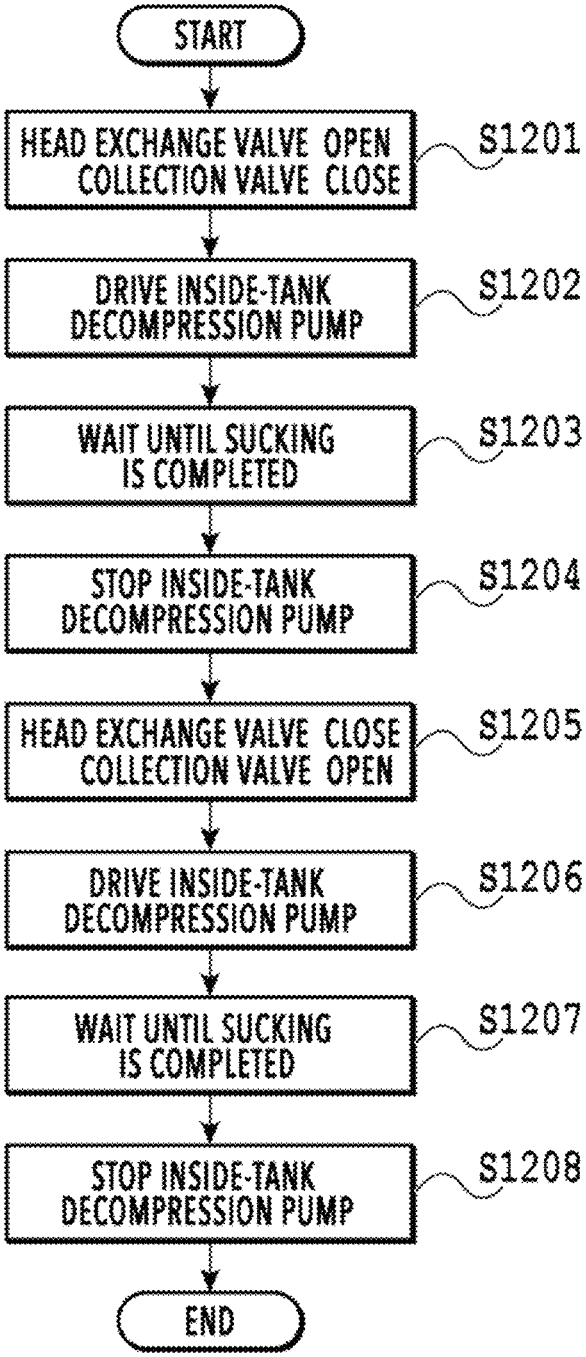
FIG. 12 shows an example of a flow chart of an ink collection process.
Figure 13:
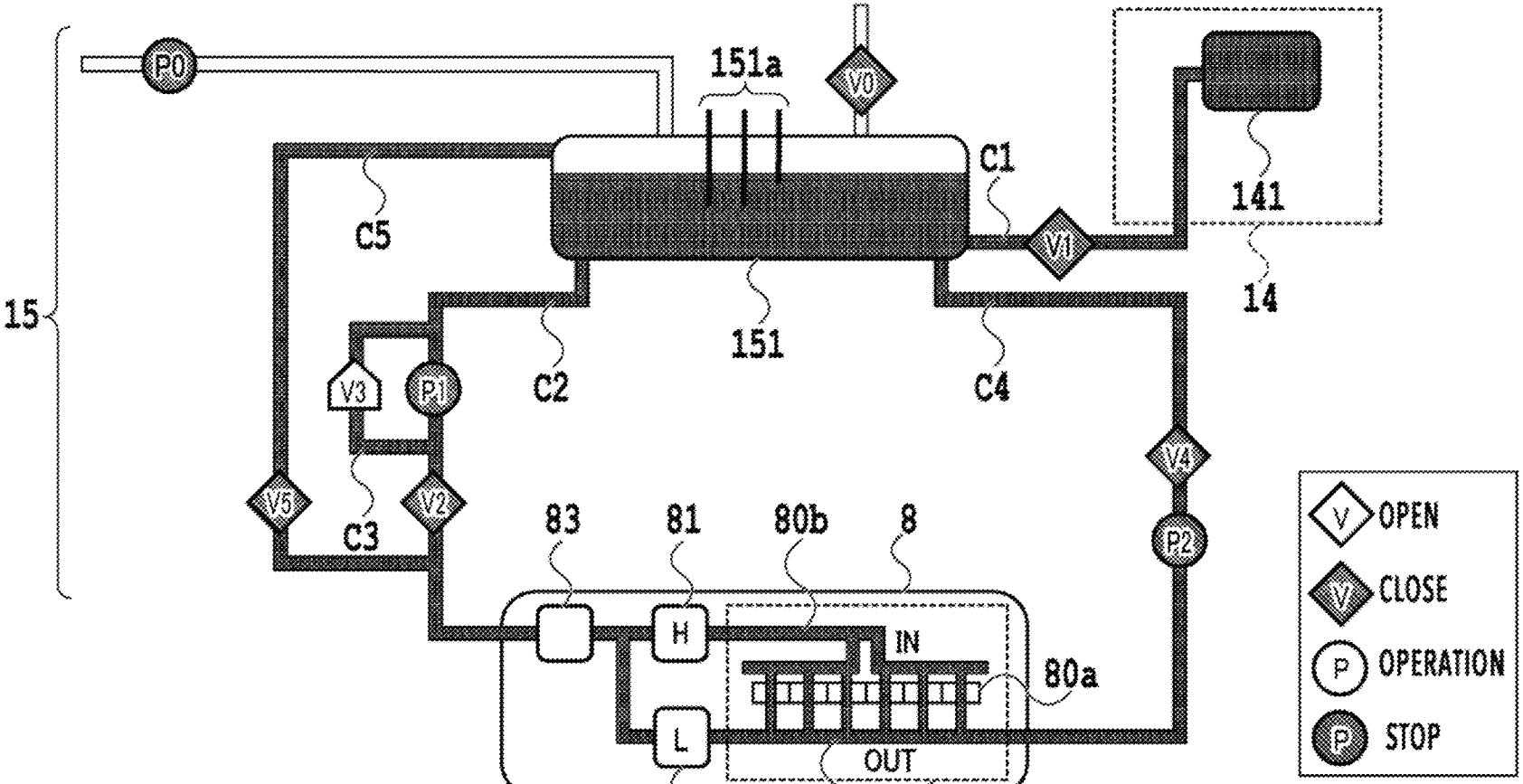
FIG. 13 shows an ink circulation system prior to starting an ink collection process.

FIG. 12 shows an example of the flow chart of an ink collection process in this embodiment. The ink collection process is executed by the ink supply control unit 209 which controls the operation of various types of pumps and various types of valves provided in the ink supply unit 15. The ink supply control unit 209 has controls to drive and stop various types of pumps including the decompression pump P0 (referred to also as the inside-tank decompression pump) which decompresses the inside of the sub-tank. Moreover, the ink supply control unit 209 has controls so as to be able to open/close various types of valves including the head exchange valve V5 (referred to also as the exchange drive valve) and collection valve V4. The state of the ink circulation system prior to staring the ink collection process is as shown in FIG. 13. That is, the atmosphere open valve V0, the tank supply valve V1, the supply valve V2, the collection valve V4, and the head exchange valve V5 are closed (CLOSE). Moreover, the decompression pump P0, the supply pump P1, and the collection pump P2 are stopped.

First, in step S1201, the ink supply control unit 209 opens the head exchange valve V5 (OPEN). Meanwhile, the ink supply control unit 209 keeps the collection valve V4 (referred to also as the collection drive valve) in the closed state (CLOSE). Then, in step S1202, the ink supply control unit 209 drives the decompression pump P0 (referred to also as the inside-tank decompression pump) to generate a negative pressure in the sub-tank 151. As the result, collection of ink on the upstream flow path side is started.

Figure 14:
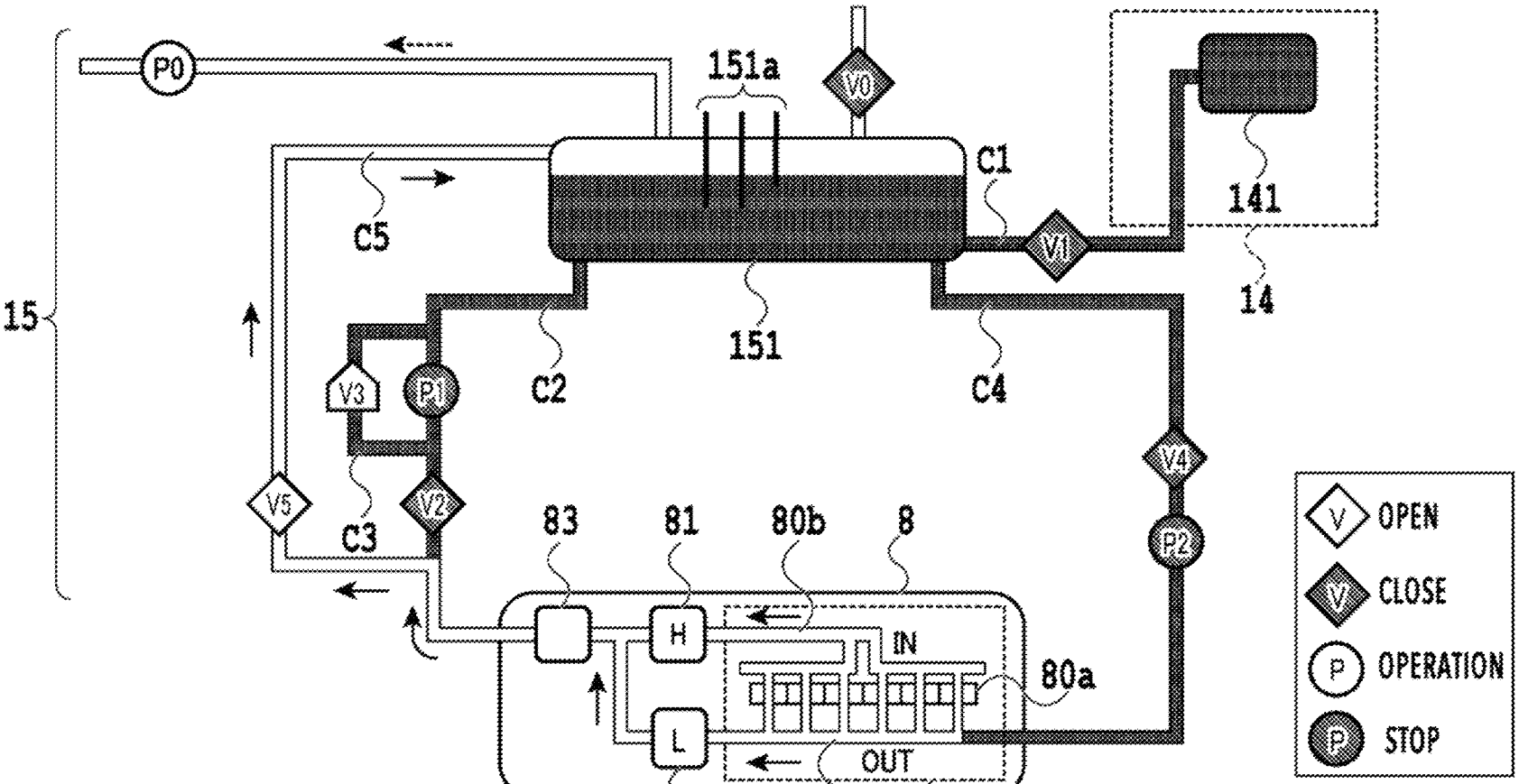
FIG. 14 shows an ink circulation system in which ink collection on an upstream flow path side is being performed.

FIG. 14 shows the state of the ink circulation system in which the ink collection on the upstream flow path side is being performed. The head exchange valve V5 is opened (OPEN), and with a negative pressure which is generated in the sub-tank 151 by driving the decompression pump P0, some of the ink in the head exchange flow path C5 and supply flow path C2 is being collected into the sub-tank 151. Moreover, most of the ink filled in the print head 8 is being collected into the sub-tank 151 through the head exchange flow path C5. As a specific phenomenon, first with the negative pressure generated by the decompression pump P0, meniscus formed in the ejection port surface 8*a* of the print head 8 is destroyed. Then, from the ejection port surface 8*a* in which the meniscus has been destroyed, atmospheric air flows in, and the ink filled in the print head 8 together with the atmospheric air which has flowed in is collected into the sub-tank 151 through the head exchange flow path C5. As described above, the ink is collected from the ejection port surface 8*a*, so as shown in FIG. 14 in the print head 8, some of the ink remains in a flow path on the collection flow path C4 side on the downstream side of the ejection port surface 8*a*. Moreover, ink is collected from the ejection port surface 8*a* through the head exchange flow path C5, so some of ink remains in the supply flow path C2 on the upstream side of the third connection which is the connection of the head exchange flow path C5 and the supply flow path C2.

In step S1203, the ink supply control unit 209 waits for a predetermined time until the collection of ink is completed. Then, in step S1204, the ink supply control unit 209 stops the decompression pump P0. Through the above-described processes, the collection of ink from most of the inside of the print head 8 and from some of the upstream flow path side is completed.

Subsequently, in step S1205, the ink supply control unit 209 closes the head exchange valve V5 (CLOSE). Meanwhile, the ink supply control unit 209 opens the collection valve V4 (OPEN). Then, in step S1206, the ink supply control unit 209 drives the decompression pump P0 (referred to also as the inside-tank decompression pump) to generate a negative pressure in the sub-tank 151. As the result, collection of the ink on the collection flow path C4 side (downstream flow path side) is started.

Figure 15:
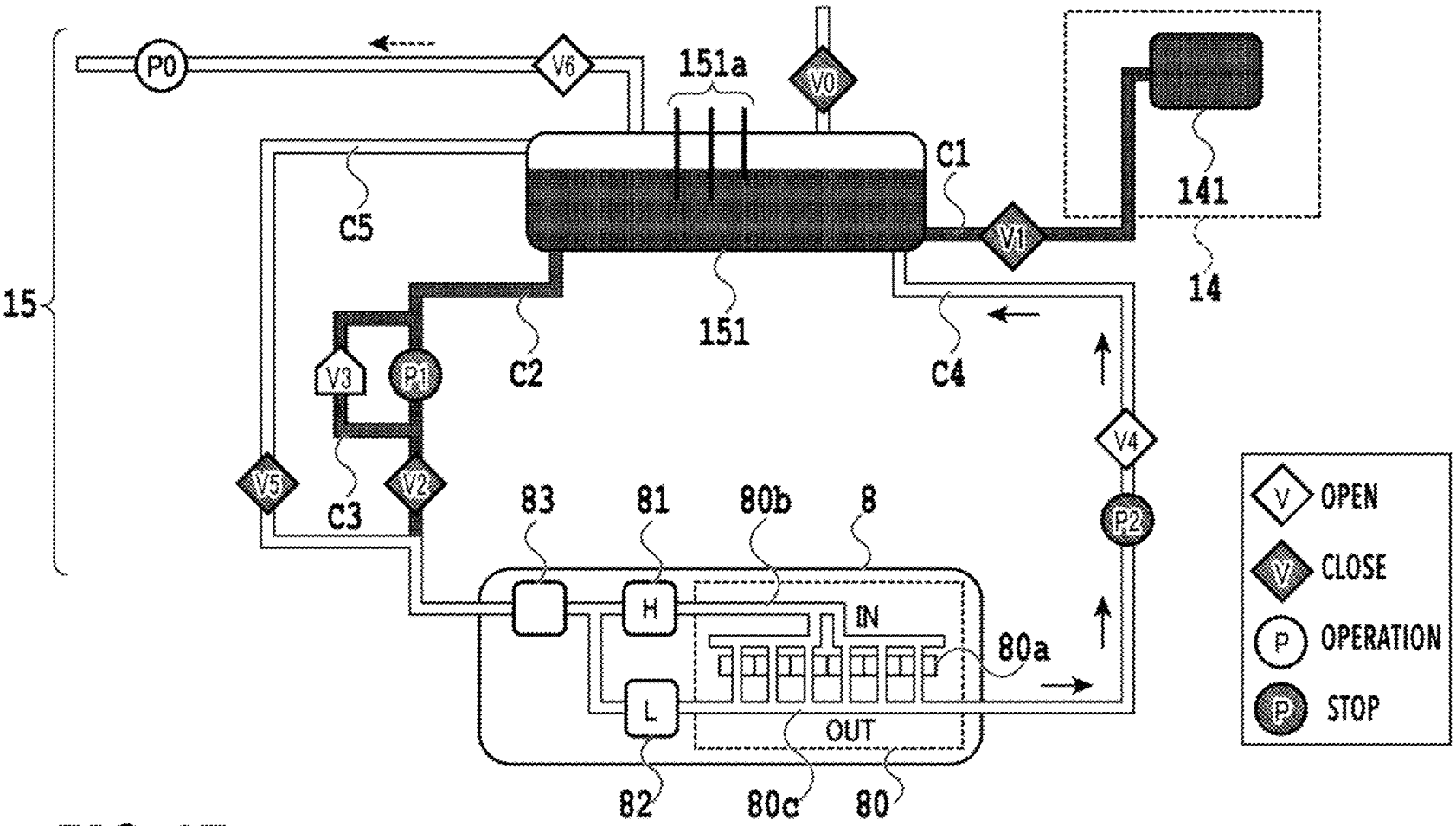
FIG. 15 shows an ink circulation system in which ink collection on a collection flow path side is being performed.

FIG. 15 shows the state of the ink circulation system in which the ink collection on the collection flow path C4 side is being performed. The head exchange valve V5 is closed (CLOSE), while the collection valve V4 is opened (OPEN). Then, with a negative pressure which is generated in the sub-tank 151 by driving the decompression pump P0, the ink of the collection flow path C4 and the ink partially remaining in the print head 8 are being collected into the sub-tank 151. In the previous collection process on the upstream flow path side, meniscus in the ejection port surface 8*a* of the print head 8 has already being destroyed. From the ejection port surface 8*a* in which the meniscus has been destroyed, atmospheric air flows in, and the ink filled in the print head 8 together with the atmospheric air which flowed in is collected into the sub-tank 151 through the collection flow path C4. As described above, by performing the ink collection process from both the supply flow path C2 side (upstream flow path side) and the collection flow path C4 side, respectively, the ink filled in the print head 8 can be appropriately collected.

In step S1207, the ink supply control unit 209 waits for a predetermined time until the collection of ink is completed.

Then, in step S1208, the ink supply control unit 209 stops the decompression pump P0. Through the processes from step S1205 to step S1208, the collection of the ink partially remaining in the print head 8 and the ink in the collection flow path C4 is completed.

When exchanging the print head 8, the print head 8 is exchanged after collecting the ink in the print head 8 in this manner. However, due to suspension of the exchanging work or the like, it may be unable to determine whether ink remains in the print head 8 or ink has been collected. Then, the presence or absence of ink (item to be supported) can be determined by performing a determination process, which will be described next, to determine the presence or absence of ink in the print head 8.

Figure 16:
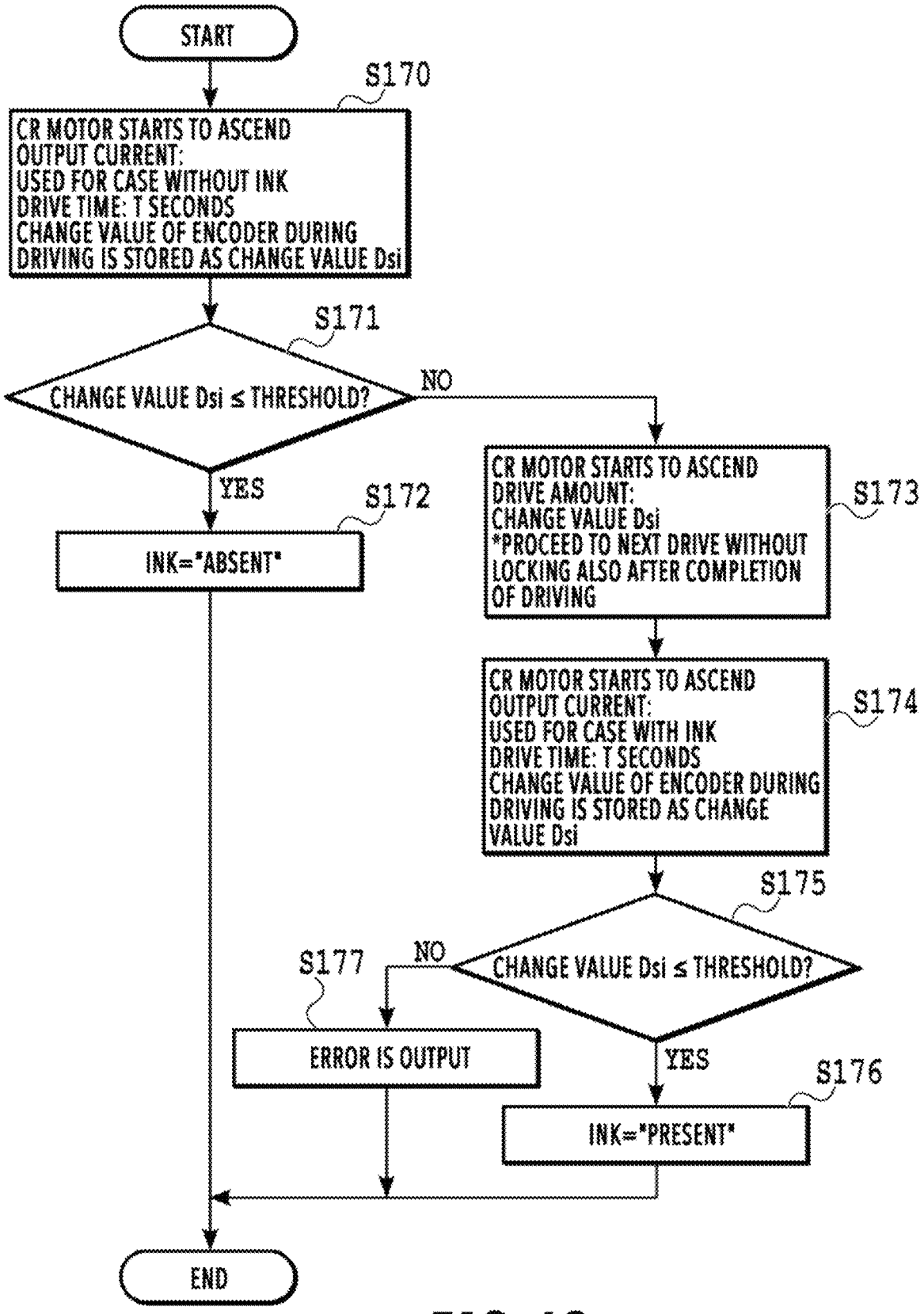
FIG. 16 is a flow chart showing a determination process to determine presence or absence of ink inside a print head.

FIG. 16 is a flow chart showing the determination process to determine the presence or absence of ink in the print head 8 in this embodiment. Hereinafter, the determination process to determine the presence or absence of ink in the print head 8 of this embodiment will be described using this flow chart. Once the determination process to determine the presence or absence of the ink in the print head 8 is started, then in S170 the carriage motor 92 is driven for T seconds with a weak current capable of maintaining the posture of the head holder 90 equipped with the print head 8 containing no ink. Then, the change value Dsi of the rotary encoder 110 for the T seconds is stored into a memory.

Subsequently, in S171, the change value Dsi which has been stored in S170 is compared with a threshold, and if the change value Dsi is equal to or less than the threshold, the determination result that "no ink" is output in S172, and the process is terminated. If the change value Dsi is larger than the threshold, it is considered that the posture of the head holder 90 cannot be maintained with the weak current, so the moving amount may have become too large. Therefore, the flow transitions to S173, where the head holder 90 is moved by the moving amount corresponding to the change value Dsi and returned to the determination position. Then, in S174, while driving the carriage motor 92 for T seconds with a current capable of maintaining the posture of the head holder 90 equipped with print head 8 containing ink, the change value Dsi of the rotary encoder 110 for the T seconds is stored into a memory. Subsequently, in S175, the change value Dsi which has been stored in S174 is compared with a threshold, and if the change value Dsi is equal to or less than the threshold, the determination result that "there is ink" is output in S176, and the process is terminated. If the change value Dsi is larger than the threshold, then it is determined that there is an abnormality in operation, and an error is output in S177 and the process is terminated.

As described above, based on the change value Dsi of the rotary encoder 110 while providing a predetermined current to the carriage motor 92, the presence or absence of the ink in the print head 8 which the head holder 90 supports is determined. Thus, an inkjet printing apparatus capable of maintaining the posture of the holder 90 appropriately regardless of the presence or absence of the ink in the print head 8 which the holder 90 supports and a method for controlling the inkjet printing apparatus can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-068360 filed Mar. 30, 2018, which is hereby incorporated by reference wherein in its entirety.

What is claimed is:

1. A printing apparatus comprising:

a holder unit capable of holding a print head and movable in a gravity direction;

a drive unit configured to drive the holder unit;

an acquisition unit configured to acquire a moving amount of the holder unit; and a determination unit configured to determine whether or not the holder unit holds the print head, wherein the determination unit determines whether or not the holder unit holds the print head based on the moving amount acquired by the acquisition unit while the drive unit is driving the holder unit with a first driving force capable of maintaining a posture of the holder unit which does not hold the print head.

2. The printing apparatus according to claim 1, wherein the determination unit determines, in a case where the moving amount is greater than a threshold, that the holder unit is holding the print head, and in a case where the moving amount is less than the threshold, that the holder unit is not holding the print head.

3. The printing apparatus according to claim 2, wherein the holder unit includes an electric contact, and wherein the print head and the holder unit can be electrically connected via the electric contact.

4. The printing apparatus according to claim 3, wherein in a case where the holder unit and the print head are not electrically connected via the electric contact, the determination unit determines based on the moving amount which is acquired by the acquisition unit while applying the first driving force to the drive unit for a predetermined time.

5. The printing apparatus according to claim 1, wherein the determination unit determines, based on the moving amount acquired by the acquisition unit, while the drive unit is driving the holder unit, with a second driving force capable of maintaining a posture of the holder unit which holds the print head.

6. The printing apparatus according to claim 1, further comprising a second determination unit configured to determine whether or not the print head held by the holder unit is filled with ink, wherein the second determination unit determines, based on the moving amount acquired by the acquisition unit while the drive unit is driving the holder unit with a third driving force capable of maintaining a posture of the holder unit which holds the print head filled with ink.

7. The printing apparatus according to claim 6, further comprising:

a tank for storing ink to be supplied to the print head;

a supply unit configured to supply ink to the print head from the tank; and a collection unit configured to collect ink from the print head to the tank.

8. The printing apparatus according to claim 7, wherein the print head is detachably mounted on the holder unit, and can be detached from the holder unit after ink is collected by the collection unit to the tank.

9. The printing apparatus according to claim 1, wherein the drive unit is a motor, and wherein the driving force is obtained by a current provided to the motor.

10. The printing apparatus according to claim 1, wherein the drive unit is engaged with a gear which transmits driving force, and wherein the holder unit moves by being transmitted driving force via the gear.

11. The printing apparatus according to claim 10, further comprising:

a lock unit configured to mechanically fix a movement of the gear, wherein the lock unit does not lock the movement of the gear in a case where the drive unit is driving the holder unit with the first driving force.

12. The printing apparatus according to claim 1, wherein the print head includes a plurality of ejection ports ejecting ink, the plurality of ejection ports being arranged in an area corresponding to a width of a print medium.

13. A method for controlling a printing apparatus comprising:

(a) a holder unit capable of holding a print head and movable in a gravity direction; and (b) a drive unit configured to drive the holder unit, the method comprising the steps of:

acquiring a moving amount of the holder unit while driving the driving unit with a first driving force capable of maintaining a posture of the holder unit which does not hold the print head; and determining, based on the acquired moving amount, whether or not the holder unit is holding the print head.

14. The control method according to claim 13, wherein the determining step comprises the steps of:

determining, in a case where the moving amount is greater than a threshold, that the holder unit is holding the print head; and determining, in a case where the moving amount is less than the threshold, that the holder unit is not holding the print head.

15. A printing apparatus comprising:

a holder unit capable of holding a print head and movable in a gravity direction;

a drive unit configured to drive the holder unit;

an acquisition unit configured to acquire a moving amount of the holder unit; and a determination unit configured to determine whether or not the holder unit holds the print head, wherein the determination unit determines whether or not the holder unit holds the print head based on the moving amount acquired by the acquisition unit while the drive unit is driving the holder unit with a first driving force capable of maintaining a position of the holder unit which does not hold the print head in the gravity direction, and wherein the first driving force is capable of maintaining the position of the holder unit in the gravity direction.

16. The printing apparatus according to claim 15, wherein the determination unit determines, in a case where the moving amount is greater than a threshold, that the holder unit is holding the print head, and determines, in a case where the moving amount is less than the threshold, that the holder unit is not holding the print head.

17. The printing apparatus according to claim 15, wherein the print head includes a plurality of ejection ports ejecting ink, the plurality of ejection ports being arranged in an area corresponding to a width of a print medium.

* * * * *